US007042410B2

(12) United States Patent
Parsons

(10) Patent No.: US 7,042,410 B2
(45) Date of Patent: May 9, 2006

(54) MICROWAVE ANTENNA FEED WITH INTEGRAL BANDPASS FILTER

(75) Inventor: Scott Parsons, Draper, UT (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 10/696,116

(22) Filed: Oct. 29, 2003

(65) Prior Publication Data

US 2005/0093758 A1 May 5, 2005

(51) Int. Cl.
*H01Q 13/00* (2006.01)

(52) U.S. Cl. ..... 343/781 P; 343/781 CA

(58) Field of Classification Search ..... 343/772, 343/781 CA, 786, 781 P
See application file for complete search history.

(56) References Cited

U.S. PATENT DOCUMENTS

| | | | | |
|---|---|---|---|---|
| 3,707,681 | A * | 12/1972 | Grant | 455/275 |
| 6,219,004 | B1 * | 4/2001 | Johnson | 343/781 P |
| 2003/0128169 | A1 * | 7/2003 | Desargant et al. | 343/781 P |
| 2003/0142029 | A1 * | 7/2003 | Desargant et al. | 343/781 P |

FOREIGN PATENT DOCUMENTS

| | | | |
|---|---|---|---|
| DE | 41 40 866 | A1 * | 4/1993 |
| EP | 1 098 367 | A2 * | 5/2001 |

* cited by examiner

*Primary Examiner*—Tan Ho
*Assistant Examiner*—Leith Al-Nazer
(74) *Attorney, Agent, or Firm*—Hayes Soloway PC

(57) ABSTRACT

An antenna feed with an integrated bandpass filter is disclosed. The antenna feed contains a reflector and a dipole antenna. A bandpass filter comprising one or more bandpass filter elements is placed between the reflector and the dipole antenna. The bandpass filter elements may be configured as traces on a printed circuit board. The printed circuit board may also contain the dipole antenna. Integrating a bandpass filter with the dipole antenna results in bandpass filtering with a small insertion loss and low cost.

13 Claims, 6 Drawing Sheets

MICROWAVE ANTENNA FEED WITH INTEGRAL BANDPASS FILTER

FIELD OF INVENTION

This invention is generally directed to an antenna feed and, more particularly, to an antenna feed including an integral bandpass filter.

BACKGROUND OF THE INVENTION

Antennas are widely used throughout the industrialized world to transmit and receive electromagnetic energy. The electromagnetic energy is typically used to carry some sort of signal which can be decoded to result in usable data. Examples of the uses of antennas include cellular telephones, television, radio, radar, and numerous other applications.

An exemplary antenna of the prior art is depicted in FIG. 1. Antenna 100 contains a reflector 102 and a feed 104. The assembly containing reflector 102 and feed 104 is typically supported by some form of stand or structure 106. Antenna 100 operates in the following manner: In receiving mode, reflector 102 reflects electromagnetic waves and directs the electromagnetic waves to feed 104. In transmission mode, feed 104 transmits an electromagnetic wave that is reflected to the environment via reflector 102. The signal from/to feed 104 passes through a sutiable transmitter/receiver 108.

Another view of an antenna is presented in FIG. 3. Parabolic reflector 302 performs substantially the same function as reflector 102 of FIG. 1, i.e., directing electromagnetic waves to and from the correct point. Feed 310 contains a reflector element 304 and a dipole 306. Reflector element 304 directs the signal to/from parabolic reflector 302 to dipole 306. Dipole 306 is typically coupled to a transmitter or receiver (not shown), possibly through a device to amplify the signal.

When using antennas for communication purposes, it is often desirable to restrict the electromagnetic signal being transmitted/received to within a certain frequency range. Different frequencies are used for different purposes. For example, cellular phones are assigned frequencies within a particular range, AM and FM radio stations are assigned frequencies within another range, and so forth. When an electromagnetic signal contains frequencies that are not desirable, it becomes difficult to separate the correct signal from the unwanted frequencies (i.e., "noise"). Thus, it is desirable to maximize the signal-to-noise ratio, which is expressed in decibels (dB).

In the prior art, many antenna systems incorporate a bandpass filter between the antenna and the receiver or between the antenna and the transmitter. The effect of a bandpass filter is illustrated in FIGS. 2A and 2B. FIG. 2A presents a signal without the use of a bandpass filter. The X-axis 202 is the frequency of the signal and the Y-axis 204 is the amplitude of signal 206. It is evident that there is a large amount of signal that is outside of the desired center frequency 208. FIG. 2B presents the signal after being passed through a bandpass filter. It can be seen that signals outside of a particular range are at a lower amplitude than the signals at the desired frequency 208. By reducing the signal outside of the desired frequency, it is easier for transmitter/receiver 108 to process the signal because of the reduction in noise. Furthermore, it should also be noted that by reducing the unwanted frequencies during transmit, there is less noise introduced into the atmosphere, thereby improving the performance of other systems operating in the same frequency range, even though those systems may not have bandpass filtering.

In the prior art, the bandpass filter is typically a four or six pole ceramic filter. These filters are effective at removing unwanted frequencies, but are undesirable in a number of respects. For example, the cost of such ceramic filters can be very high. Furthermore, a significant insertion loss (a reduction of signal strength of the processed signal compared to the unprocessed signal) may be introduced by these ceramic filters, in some cases greater than 0.4 dB. Because of the low strength of the received signal, such an insertion loss is highly undesirable.

SUMMARY OF THE INVENTION

An antenna feed in accordance with the present invention generally includes one or more bandpass filter elements positioned between a dipole antenna and a reflector. In a system in which the dipole antenna is contained on a printed circuit board, the bandpass filter elements may comprise conductive traces on the printed circuit board that serve to filter unwanted frequencies.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

In general, an antenna feed in accordance with the present invention incorporates one or more bandpass filter elements (e.g., passive metallic elements) advantageously positioned with respect to the reflector element and the dipole element. The number, geometry, and spatial location of the various bandpass filter elements may be selected in accordance with, for example, the desired center frequency and bandwidth of the filter.

The present invention may be described herein in terms of various functional components, processing steps, and antenna configurations. It should be appreciated that such functional components may be realized by a variety of different hardware or structural components configured to perform the specified functions. For purposes of illustration only, exemplary embodiments of the present invention will be described herein. Further, it should be noted that, while various components may be suitably coupled or connected to other components, such connections and couplings may be realized by a direct connection between components, or by a connection through other components and devices.

Figure 1:
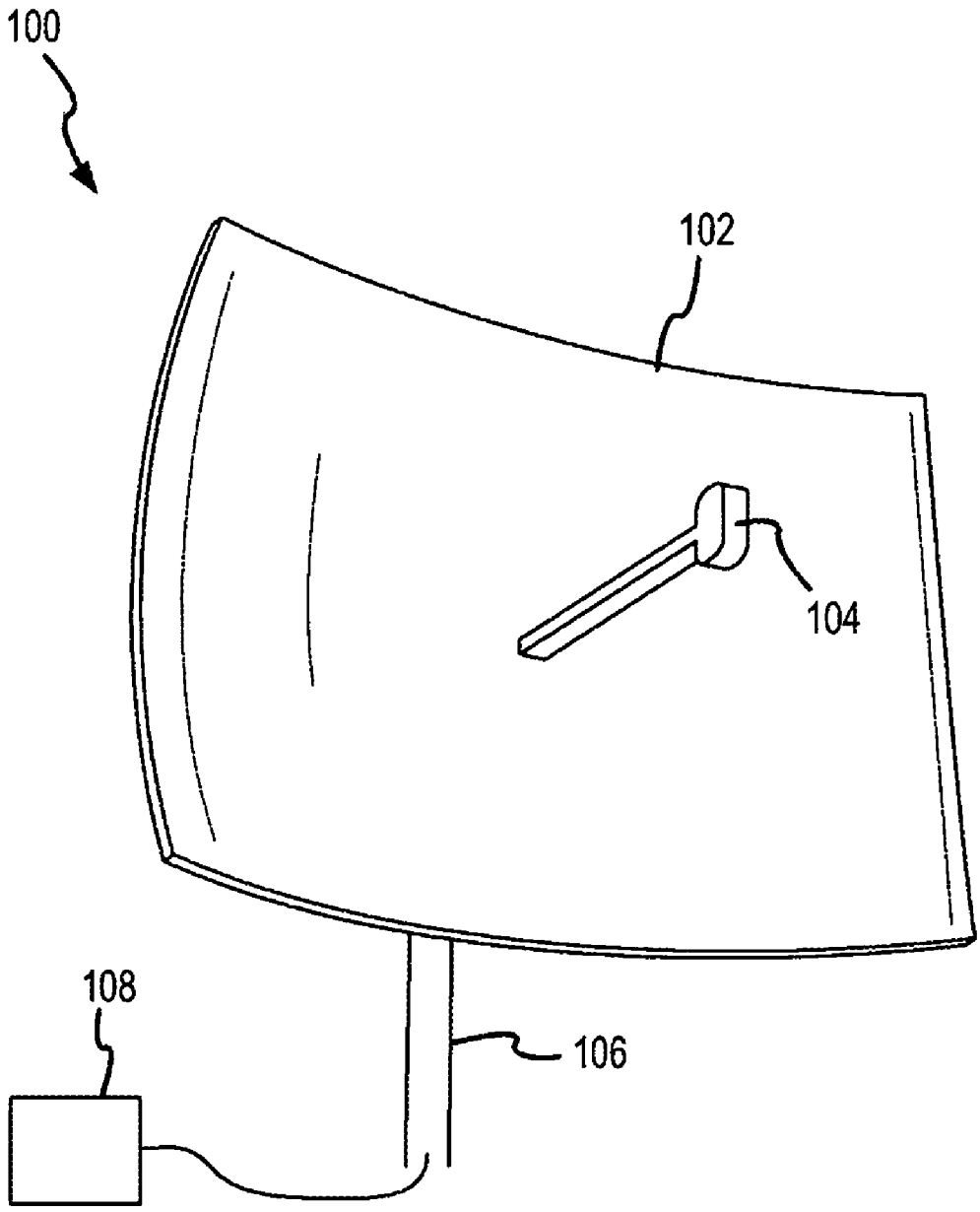
(PRIOR ART) FIG.1
FIG. 1 illustrates an antenna system of the prior art.
Figure 2A:
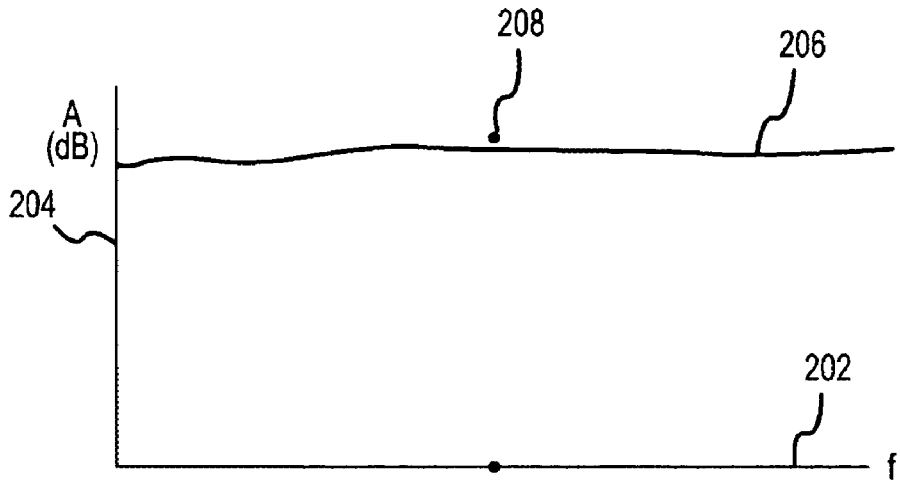
FIG.2A (PRIOR ART)
FIGS. 2A and 2B are graphs illustrating the effect of a bandpass filter.
Figure 2B:
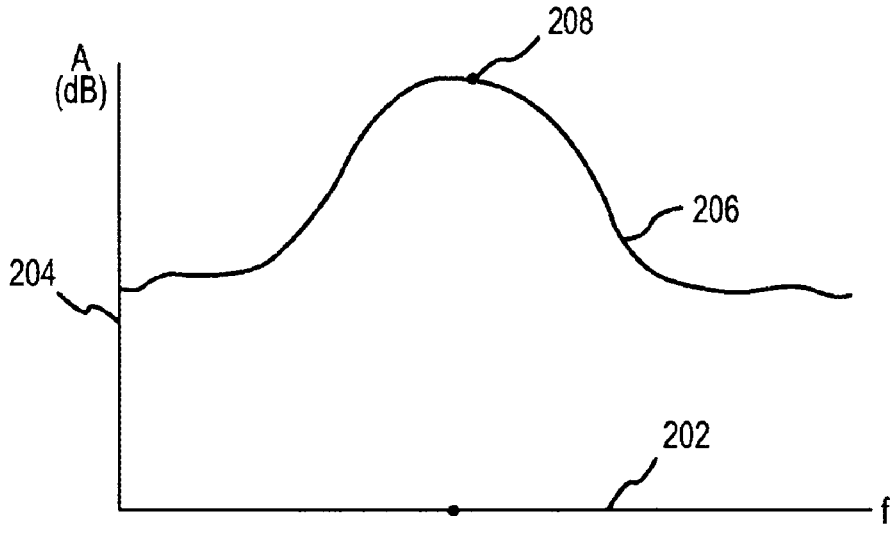
FIG.2B (PRIOR ART)
Figure 3:
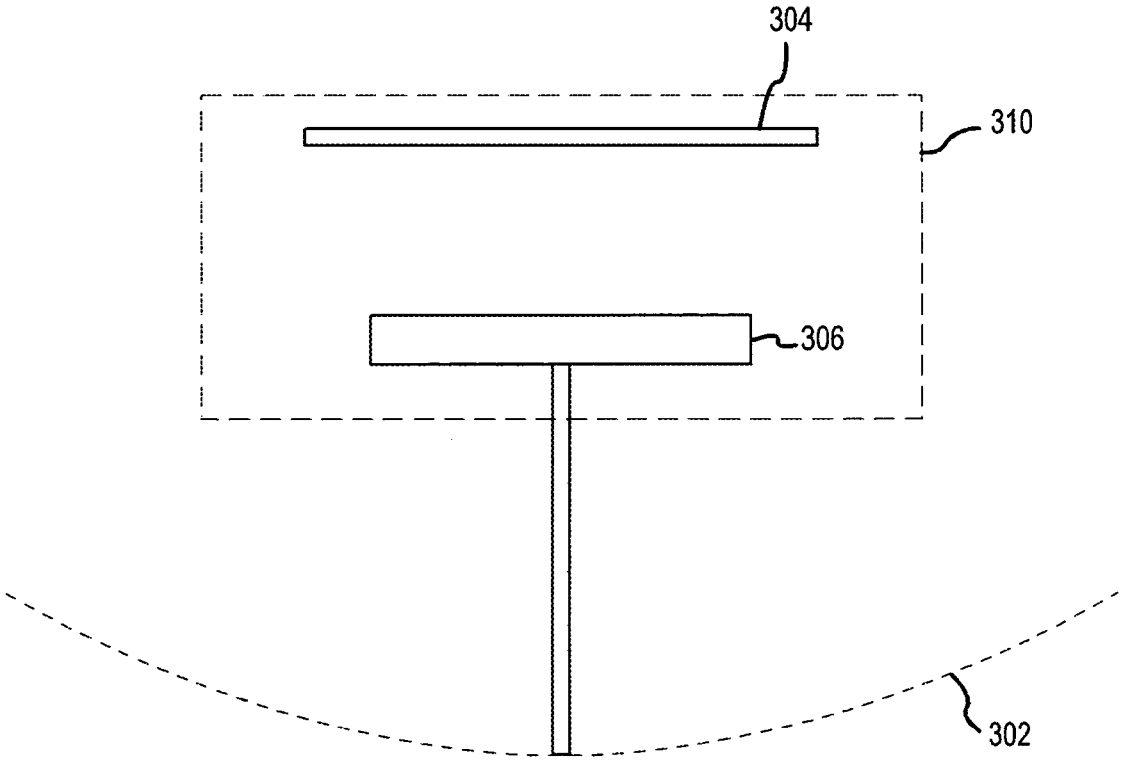
FIG.3 (PRIOR ART)
FIG. 3 is a cross-section view of an antenna system of the prior art.
Figure 4:
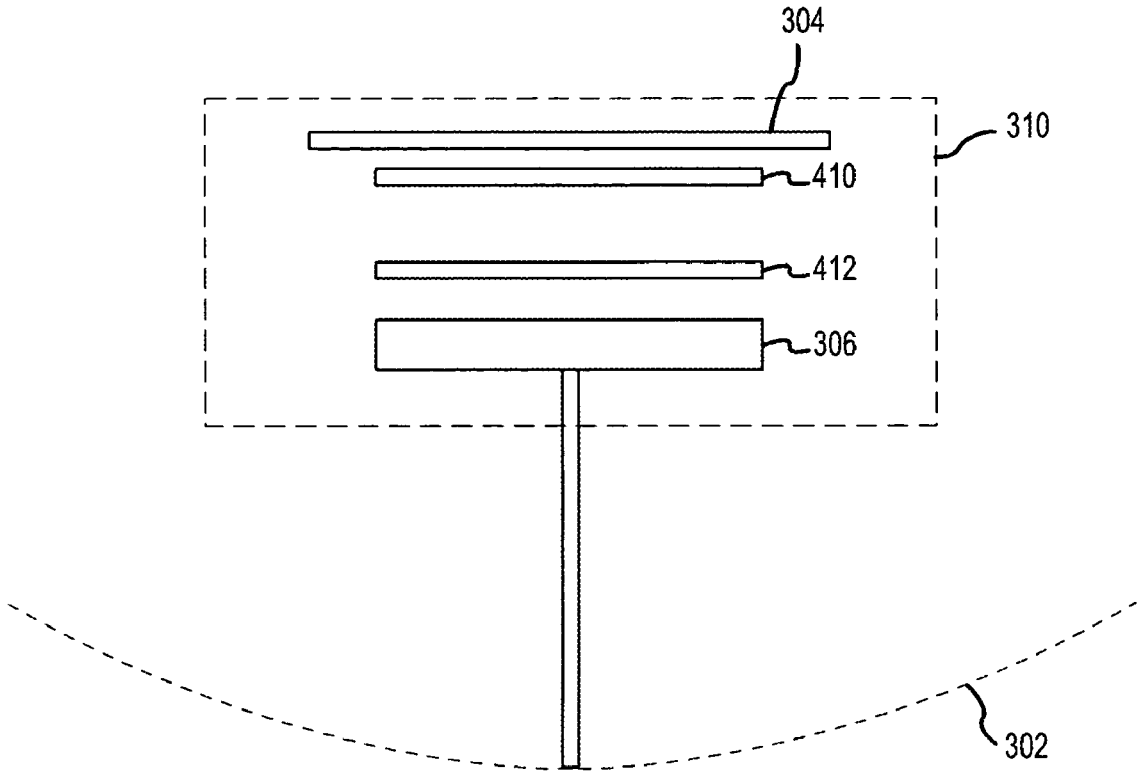
FIG. 4 is a cross-section view of an antenna system in accordance with an embodiment of the present invention.

With reference to FIG. 4, an exemplary embodiment of the present invention is shown in cross-section in the context of a parabolic antenna as depicted in FIG. 3. Parabolic reflector 302, feed 310, reflector 304, and dipole 306 are comparable to the respective elements shown in FIG. 3. In accordance with the present invention, however, two bandpass filter elements 410 and 412 are provided between reflector 304 and dipole 306. The presence of filter elements 410 and 412 provide a bandpass filter effect, thereby reducing out-of-band noise, increasing efficiency, and increasing the signal-to-noise ratio.

In one embodiment of the present invention, bandpass filter elements 410 and 412 are constructed as metallic elements placed between reflector 304 and dipole 306 within an antenna feed housing. In the illustrated embodiment, bandpass elements 410 and 412 are placed symmetrically with respect to dipole 306 and reflector 304.

While the embodiment shown in FIG. 4 depicts two bandpass elements having uniform cross-sectional thicknesses positioned parallel to each other between dipole 306 and reflector 304, the present invention comprehends any number of variations of this configuration, for example: the use of any number of bandpass elements (e.g., 1, 2, 3, or more elements); the use of bandpass elements having rectilinear, curvilinear, or any other suitable shape; the use of symmetrical and/or non-symmetrical elements; and the symmetrical and/or non-symmetrical positioning of the elements with respect to each other and other antenna components within the system. Furthermore, while the illustrated embodiment has been described in the context of metallic bandpass elements, the present invention is suitably implemented using any material or combination of materials capable of affecting the electromagnetic field of the antenna, including various metals, composite materials, and/or semiconductor materials.

In an alternate embodiment of the present invention, various components of the antenna are constructed on a printed circuit board ("PCB") or other suitable planar substrate (for example, a semiconductor or high dielectric constant substrate). Accordingly, such antenna systems are often referred to as "planar," or "uniplanar" antennas.

Figure 5B:
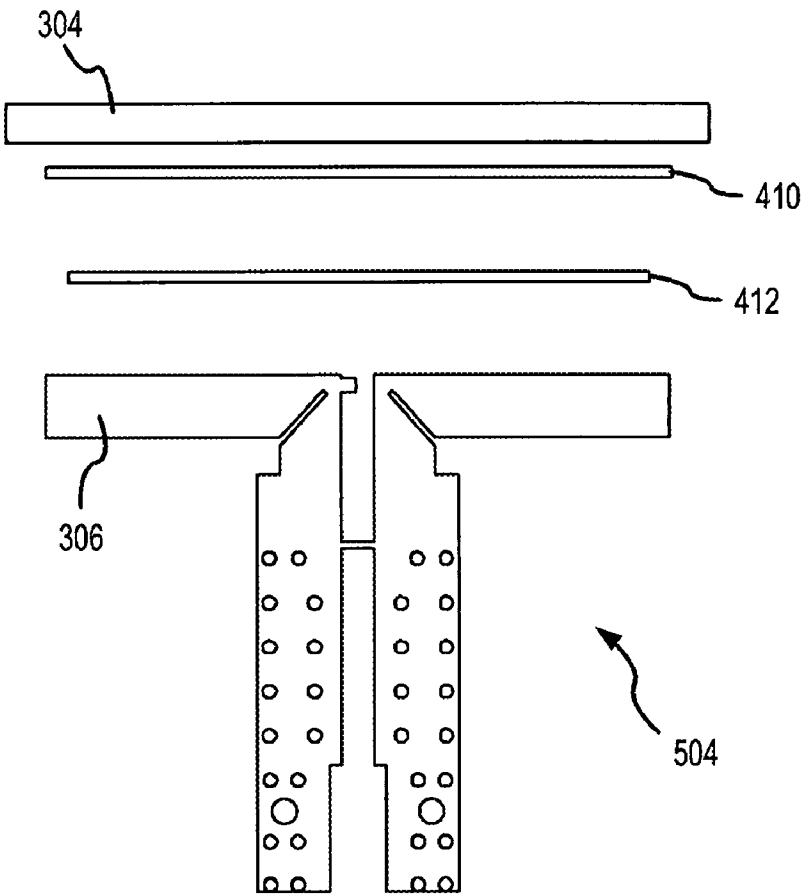
FIG. 5B illustrates an antenna in accordance with the present invention, as implemented on a PCB.
Figure 5A:
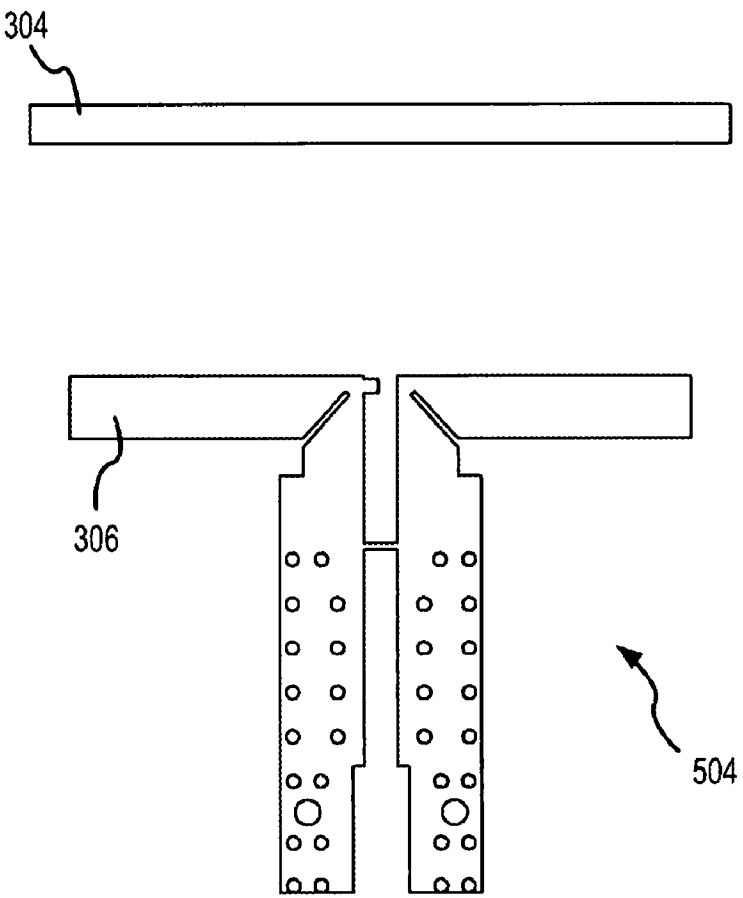
FIG.5A (PRIOR ART)
FIG. 5A illustrates a prior art antenna implemented on a printed circuit board (PCB)

FIG. 5B illustrates an exemplary planar antenna feed, wherein bandpass filter elements 410 and 412 are implemented as substantially planar rectangular traces on the surface of the substrate 504. In contrast, prior art planar antennas are typically configured as shown in FIG. 5A, and thus require additional circuitry to implement the bandpass filter.

There is little extra cost involved in creating such feature (i.e., bandpass elements 410 and 412), because there is no external element needed; bandpass elements 410 and 412 may be fabricated at the same time dipole 306 and reflector 304 are fabricated. In this regard, the various antenna components may be deposited, grown, or otherwise fabricated using any suitable technique now known or later developed, including conventional PCB and semiconductor processing techniques.

Bandpass elements 410 and 412 comprise any suitable field-altering material, including various metals (copper, brass, aluminum, gold, etc.) and semiconductors (polycrystalline silicon, etc.), and may be fabricated as thick or thin films. In one embodiment, the bandpass elements comprise a metal (e.g., copper) having a thickness of between about 0.6 and 0.8 mils.

As discussed above, the shape, size, and layout of bandpass elements 410 and 412 are selected in accordance with the total bandwidth and center frequency required of the bandpass filter. In one embodiment, detailed below in conjunction with FIG. 6, the bandpass elements 410 and 412 are configured to produced a bandpass frequency range of about 2400 MHz to 2483 MHz, with a center frequency of about 2440 MHz, wherein signals outside this range are attenuated approximately 15 dB. Such an embodiment is particularly applicable in wireless modem applications (i.e., "WiFi") conforming to one or more of the 802.11 specifications, such as 802.11b. That is, a planar antenna feed in accordance with the present invention may be incorporated into personal data assistants, portable computers, Ethernet cards, pagers, or any other such wireless device.

Figure 6:
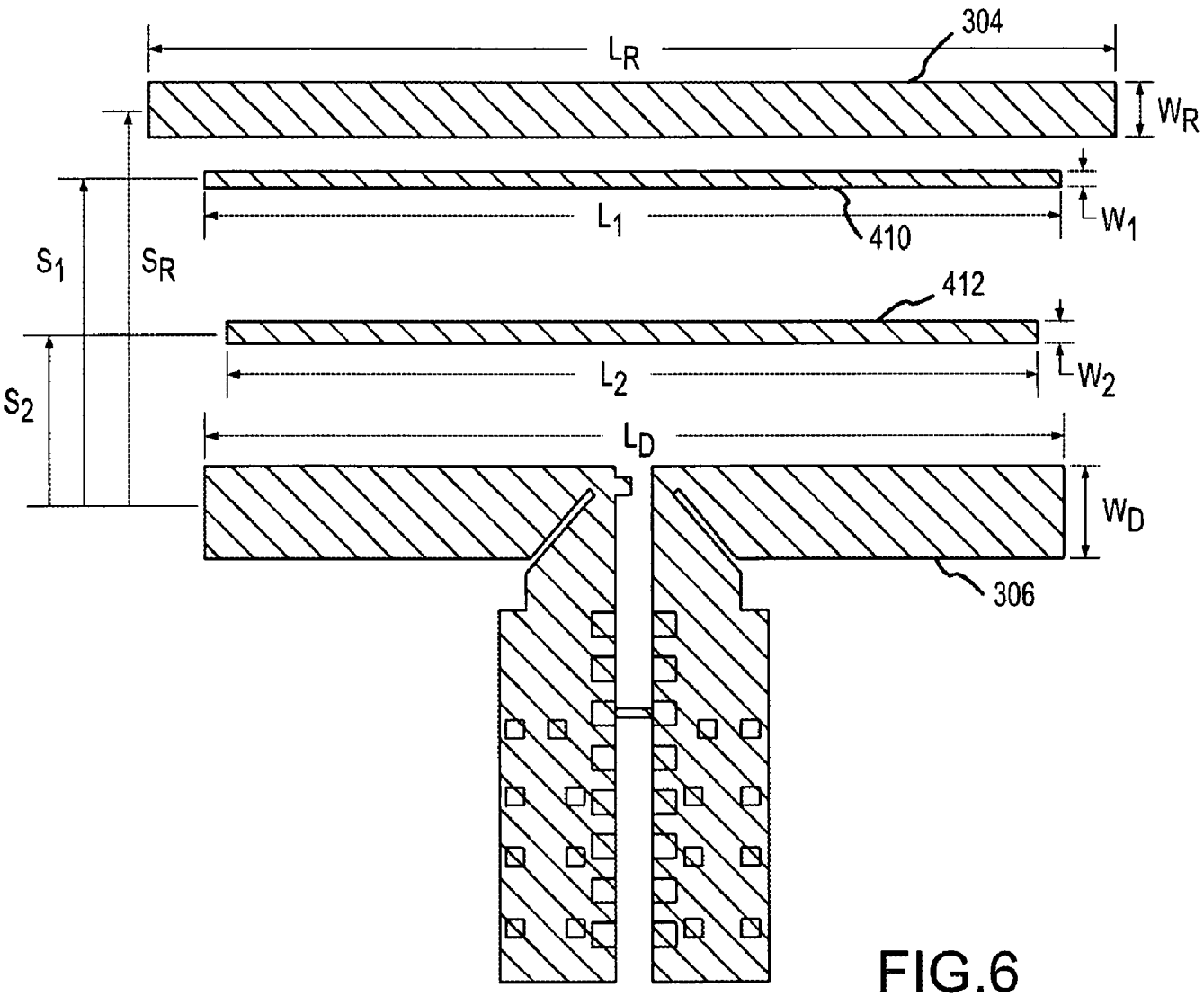
FIG. 6 illustrates a PCB antenna in accordance with the present invention, showing exemplary measurements.

As shown in FIG. 6, the illustrated embodiment includes two elongated rectangular elements 410 and 412 positioned symmetrically between reflector 304 and dipole 306. Dipole 306 has a width $W_D$ and a length $L_D$. Similarly, reflector 304 has a length $L_R$ and width $W_R$. Bandpass element 410 is an elongated rectangular element having a length $L_1$, a width $W_1$, and a center line located $S_1$ from the centerline of dipole 306. Bandpass element 412 has a length $L_2$, a width $W_2$, and a center line located $S_2$ from dipole 306.

The ratios of distances, thicknesses, and widths shown in FIG. 6 may be selected in accordance with the desired bandpass characteristics. Normalizing by the length and width of dipole 306 ($L_D$ and $W_D$), for example, the illustrated embodiment has the following approximate dimensionless values:

$L_R/L_D=1.15$
$S_R/L_D=0.45$
$L_1/L_D=1.00$
$S_1/L_D=0.38$
$S_2/L_D=0.21$
$L_2/L_D=0.48$
$W_R/W_D=0.63$
$W_1/W_D=0.18$
$W_2/W_D=0.23$

Furthermore, in a preferred embodiment, $W_D$ has a value in the range of approximately 190 mils to approximately 200 mils, preferably between approximately 192 mils and 197 mils, and most preferably approximately 195 mils. Similarly, $L_D$ has a value in the range of approximately 205 mils to approximately 215 mils, preferably between approximately 207 mils and 213 mils, and most preferably approximately 210 mils.

As mentioned above, the particular dimensions of the planar antenna feed are selected to implement the desired filter characteristics. This selection may be accomplished in a number of ways, for example, through computer modeling (based appropriate electromagnetic field relations), empirical studies, closed-form solutions, or a combination thereof. Furthermore, the methods of the present invention may be employed to implement other forms of filters, e.g., low-pass filters, high-pass filters, and higher order filters.

It is to be understood that the above-described embodiments are merely illustrative of some of the many specific embodiments which represent applications of the principles of the present invention. Numerous other arrangements can be readily devised by those skilled in the art without departing from the scope of the invention.

I claim:

1. An antenna comprising:

a feed assembly.

wherein said feed assembly comprises:

a substrate;

a dipole on said substrate;

a reflector on said substrate; and at least one bandpass filter element on said substrate, operationally between said dipole and said reflector.

2. The antenna feed assembly of claim 1, wherein said bandpass filter elements comprise conductive traces fabricated on said substrate.

3. The antenna feed assembly of claim 2, wherein said substrate comprises a printed circuit board.

4. The antenna feed assembly of claim 2, wherein said at least one bandpass filter comprises a material selected from the group consisting of metals and semiconductors.

5. The antenna feed assembly of claim 4, wherein said at least one bandpass filter comprises a metal selected from the group consisting of copper, brass, aluminum, and gold.

6. The antenna feed assembly of claim 2, wherein said at least one bandpass filter element comprises a first bandpass filter element and a second band pass filter element.

7. The antenna feed assembly of claim 6, wherein said first and second bandpass filter elements are elongated rectangles parallel to an edge of said dipole.

8. The antenna feed assembly of claim 6, wherein said at least one band pass filter element has a bandwidth of approximately 2400 MHz to approximately 2500 MHz.

9. A planar antenna feed assembly comprising:

a substantially planar substrate;

a dipole and a reflector provided on said substrate;

a first bandpass filter element provided on said substrate, operationally between said dipole and said reflector; and a second bandpass filter element provided on said substrate, operationally between said dipole and said reflector.

10. The planar antenna feed assembly of claim 9, wherein said dipole has a width $W_D$ and a length $L_D$; said first bandpass element is an elongated rectangular having a length $L_1$, a width $W_1$, and a center line located $S_1$ from the centerline of said dipole; said second bandpass element has a length $L_2$, a width $W_2$, and a center line located $S_2$ from said dipole; and wherein:

$L_1/L_D$ is approximately 1.00;

$S_1/L_D$ is approximately 0.4;

$S_2/L_D$ is approximately 0.20; and $L_2/L_D$ is approximately 0.5.

11. The planar antenna feed assembly of claim 10, wherein $W_1/W_D$ is approximately 0.18, and $W_2/W_D$ is approximately 0.23.

12. The planar antenna feed assembly of claim 9, wherein said at first and second bandpass filter elements implement a bandpass filter having a bandwidth of approximately 2400 MHz to approximately 2500 MHz.

13. An antenna feed assembly comprising:

a dipole on a substrate;

a reflector; and a first bandpass filter element and a second bandpass filter element, wherein at least one of said bandpass filter elements comprises conductive traces fabricated on said substrate and wherein said first and second bandpass filter elements are elongated rectangles parallel to an edge of said dipole.

* * * * *

UNITED STATES PATENT AND TRADEMARK OFFICE

CERTIFICATE OF CORRECTION

PATENT NO. : 7,042,410 B2
APPLICATION NO. : 10/696116
DATED : May 9, 2006
INVENTOR(S) : Parsons It is certified that error appears in the above-identified patent and that said Letters Patent is hereby corrected as shown below:

Col. 4, Claim 1, Line 63, after assembly, "." (period) should be ";" (semi colon).
Col. 5, Claim 6, Line 16, "band pass" should be --bandpass--.
Col. 5, Claim 8, Line 21, "band pass" should be --bandpass--.

Signed and Sealed this

Twenty-fifth Day of July, 2006

JON W. DUDAS
*Director of the United States Patent and Trademark Office*